US009756912B1

(12) United States Patent
Haythornthwaite

(10) Patent No.: US 9,756,912 B1
(45) Date of Patent: Sep. 12, 2017

(54) WIND RESISTANT UMBRELLA

(71) Applicant: Shedrain Corporation, Portland, OR (US)

(72) Inventor: David Haythornthwaite, Fujian Province (CN)

(73) Assignee: SHEDRAIN CORPORATION, Portland, OR (US)

( * ) Notice: Subject to any disclaimer, the term of this patent is extended or adjusted under 35 U.S.C. 154(b) by 0 days.

(21) Appl. No.: 15/051,980

(22) Filed: Feb. 24, 2016

(51) Int. Cl.
*A45B 25/22* (2006.01)
*A45B 25/18* (2006.01)
*A45B 25/02* (2006.01)

(52) U.S. Cl.
CPC ..... *A45B 25/22* (2013.01); *A45B 25/02* (2013.01); *A45B 25/18* (2013.01)

(58) Field of Classification Search
CPC ..... A45B 25/22; A45B 25/18; A45B 25/02
See application file for complete search history.

(56) References Cited

U.S. PATENT DOCUMENTS 2,185,587 A * 1/1940 Carlisle ..... A45B 25/02 135/33.5
2,551,297 A 5/1951 Sherman
3,431,926 A 3/1969 Dubinsky
5,065,779 A * 11/1991 Johnson ..... A45B 25/20 135/33.7
5,101,844 A 4/1992 Morrone
5,487,401 A 1/1996 Johnson et al.
5,890,506 A 4/1999 Kupferman
7,913,709 B2 * 3/2011 Brebner ..... A45B 19/06 135/31
2002/0189656 A1 * 12/2002 David ..... A45B 25/18 135/33.7
2003/0029485 A1 2/2003 Johnson et al.
2004/0211452 A1 * 10/2004 Wu ..... A45B 25/02 135/33.7
2007/0125409 A1 * 6/2007 Cullen ..... A45B 15/00 135/33.41
2009/0056774 A1 * 3/2009 Lee ..... A45B 25/02 135/15.1
2011/0088735 A1 * 4/2011 Creton ..... A45B 25/22 135/33.7
2012/0180835 A1 * 7/2012 Frost ..... A45B 25/18 135/44

FOREIGN PATENT DOCUMENTS

FR WO 2009144416 A2 * 12/2009 ..... A45B 25/22

OTHER PUBLICATIONS

"The Unflippable GustBuster Metro Umbrella—Randon Product Review" (Randomrazr) Aug. 16, 2013 (Aug. 16, 2013) [youtube.com] <URL:https://www.youtube.com/watch?v=2qcWbzj59vo> entire document, especially 01:30-02:36.

* cited by examiner

*Primary Examiner* — Noah Chandler Hawk
(74) *Attorney, Agent, or Firm* — Leason Ellis LLP

(57) ABSTRACT

A wind resistant umbrella includes an upper canopy that is attached to a lower canopy at select points. Elastic fasteners (e.g., elastic straps) elastically connect the upper canopy to the lower canopy. Flexible connectors that wrap around a peripheral edge of the lower canopy serve to both fixedly attach first ends of the elastic fasteners and provide pockets that receive free ends of the ribs to securely attach the ribs to the lower canopy.

20 Claims, 14 Drawing Sheets

WIND RESISTANT UMBRELLA

TECHNICAL FIELD

The present invention relates to umbrellas and more particularly, relates to an umbrella that is constructed to be resistant to inversion from the wind.

BACKGROUND

As is well known, an umbrella is a device that protects the user from the elements and in particular from liquid and frozen precipitation or even the sun, etc. A traditional umbrella has the following parts: a pole, a canopy, ribs, a runner, springs and a ferrule. A pole is the metal or wooden shaft that runs between the umbrella's handle at the bottom (or the base stand in the case of a patio model) and the canopy at the top. The canopy is the fabric part of the umbrella that catches the rain, the wind and the sun. The ribs are what give an umbrella its structure and shape. Outer ribs hold up the canopy and inner ribs (sometimes called stretchers) act as supports and connect the outer ribs to the umbrella pole. A runner slides up and down the pole while connected to the ribs/stretchers, and is responsible for the opening and closing of the canopy. Many umbrella designs include a top spring to hold the runner up when the canopy is open, a bottom spring to hold the runner down when the canopy is closed, and sometimes a center ball spring to extend the pole length in telescopic models. Strictly ornamental, the finial (also called the ferrule) is found on the very top of the umbrella, above the canopy.

Umbrella ribs function in a folding construction supporting the umbrella canopy fabric. Under normal operating conditions, the forces acting on the umbrella canopy fabric increase toward peak values when the canopy becomes fully deployed and when wind gusts tend to overturn the canopy. These forces are transmitted from the canopy to the canopy ribs, and can act on the ribs in opposite directions depending on the direction of the wind. The ribs thus have to be strong enough to withstand forces which can act on them from anyone of the two main opposite directions.

In addition to their strength requirements, the shape of the umbrella ribs should change between a substantially straight contour when the umbrella is folded and a curved one, when the canopy if fully deployed. The straight design is aimed to allow the folded fibs to lay parallel to the shaft of the umbrella when the umbrella is folded and the curved design provides for the typical mushroom-like shape (also called bell shaped).

SUMMARY

A wind resistant umbrella, in accordance with one embodiment of the present invention, includes a shaft and a plurality of ribs extending radially outward from the shaft. Each rib has a free end portion. The umbrella also includes a lower canopy secured in covering relation on the plurality of ribs. The lower canopy has at least one vent hole formed therein. The umbrella also has an upper canopy positioned over the lower canopy and in covering relation to the at least one vent hole.

The umbrella also includes elastic fasteners having a first end attached to the upper canopy and a second end attached to the lower canopy to permit the upper canopy to elastically separate from the lower canopy while also covering the at least one vent hole. A plurality of flexible connectors are secured along a peripheral edge of the lower canopy with a first portion of the connector lying along a first face of the lower canopy. Each connector wraps around the lower canopy such that a second portion of the flexible connector lies along a second face of the lower canopy. The first portion of the flexible connector is securely attached to the second end of the elastic fastener and to the lower canopy. The second portion of the flexible connector defines a pocket that receives the free end portion of one respective rib, thereby releasably coupling the rib to the lower canopy.

The flexible connector can be formed of rubber or a similar material and can be attached to the lower canopy using stitching. The second portion includes an opening defining an entrance to the pocket. The pocket is defined between an underside of the second portion of the flexible connector and the lower canopy.

Stitching can extend through the folded over flexible connector, the captured elastic fastener, and the lower canopy, thereby securely fixing the elastic fastener to the lower canopy and providing the pocket for the free end of the rib.

BRIEF DESCRIPTION OF THE DRAWING FIGURES

DETAILED DESCRIPTION OF CERTAIN EMBODIMENTS

As discussed herein, the present invention is directed to improvement with respect to a number of components of an umbrella including but not limited to a canopy and a rib assembly. As discussed herein, the features of the present invention can be implemented with both a manual type umbrella and an automatic type umbrella. In addition, the other features can be implemented with other types of umbrellas. Accordingly, the following discussion and figures describe exemplary embodiments that implement the teachings of the present invention.

Figure 1:
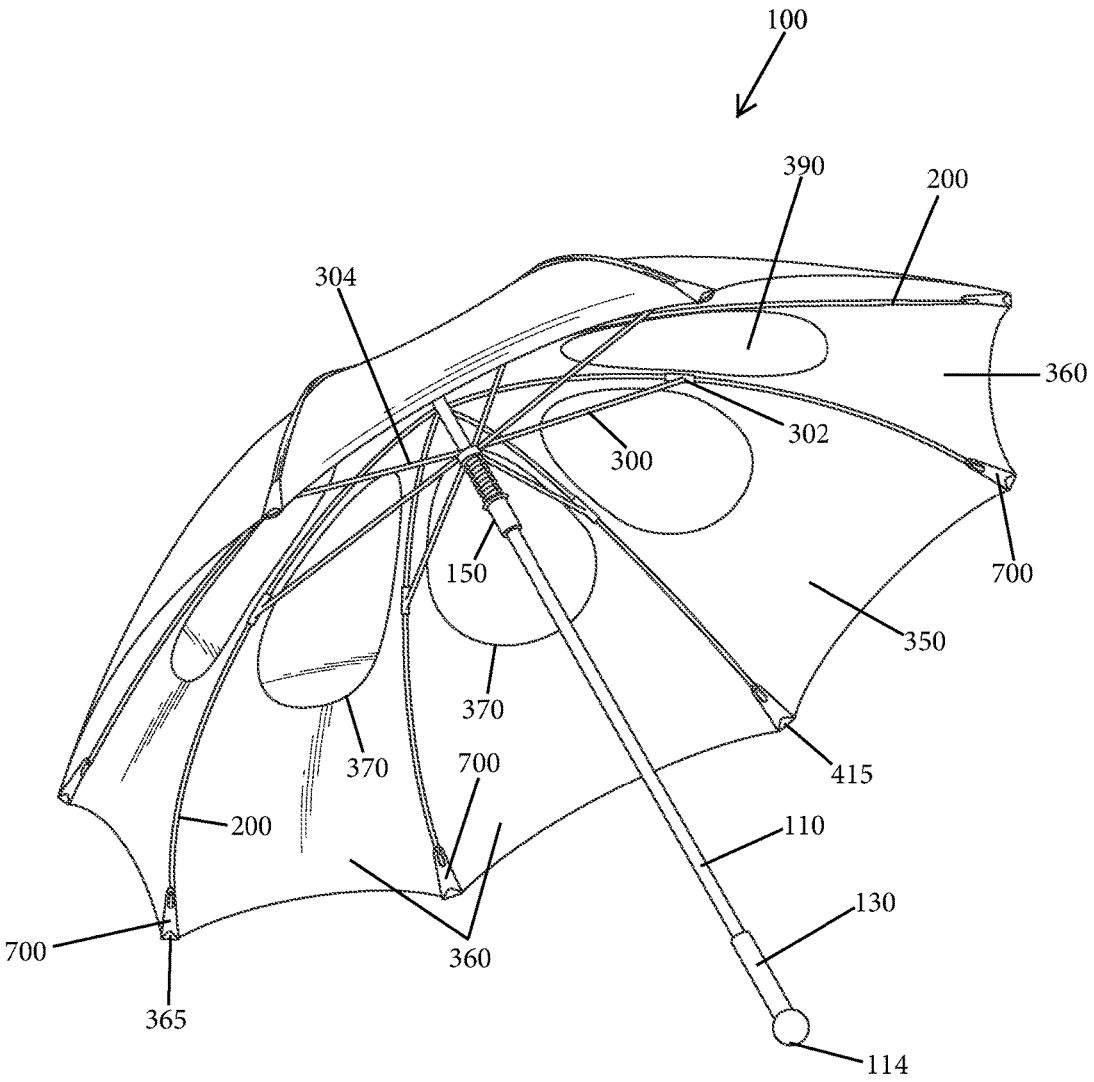
FIG. 1 is a bottom and side perspective view of a two-canopy umbrella in accordance with the present invention.

FIG. 1 shows an umbrella 100 in accordance with one exemplary embodiment of the present invention. Additional details of certain working components of umbrella 100 can be found in commonly owned U.S. patent application Ser. No. 14/614,906, which is hereby expressly incorporated by reference in its entirety. The umbrella 100 includes a shaft 110 that has a first (top) end 112 and an opposite second (bottom) end 114. The shaft 110 itself can be formed of any number of different components to cooperate to provide shaft 110 and the shaft 110 illustrated in FIG. 1 is part of a manual umbrella assembly in which the user manually opens and closes the umbrella as described herein. At the first end 112, a cap 120 is provided to close off the shaft 110 and at the second end 114, a handle 130 is provided for grasping by the user.

As mentioned above, one of the main components of an umbrella is a runner 150. The runner 150 is the part of the umbrella that opens and closes the umbrella 100, with the runner 150 moving along the shaft 110. The runner 150 is located between the coupling member 105 and the cap 120 and surrounds the shaft 110.

Figure 6:
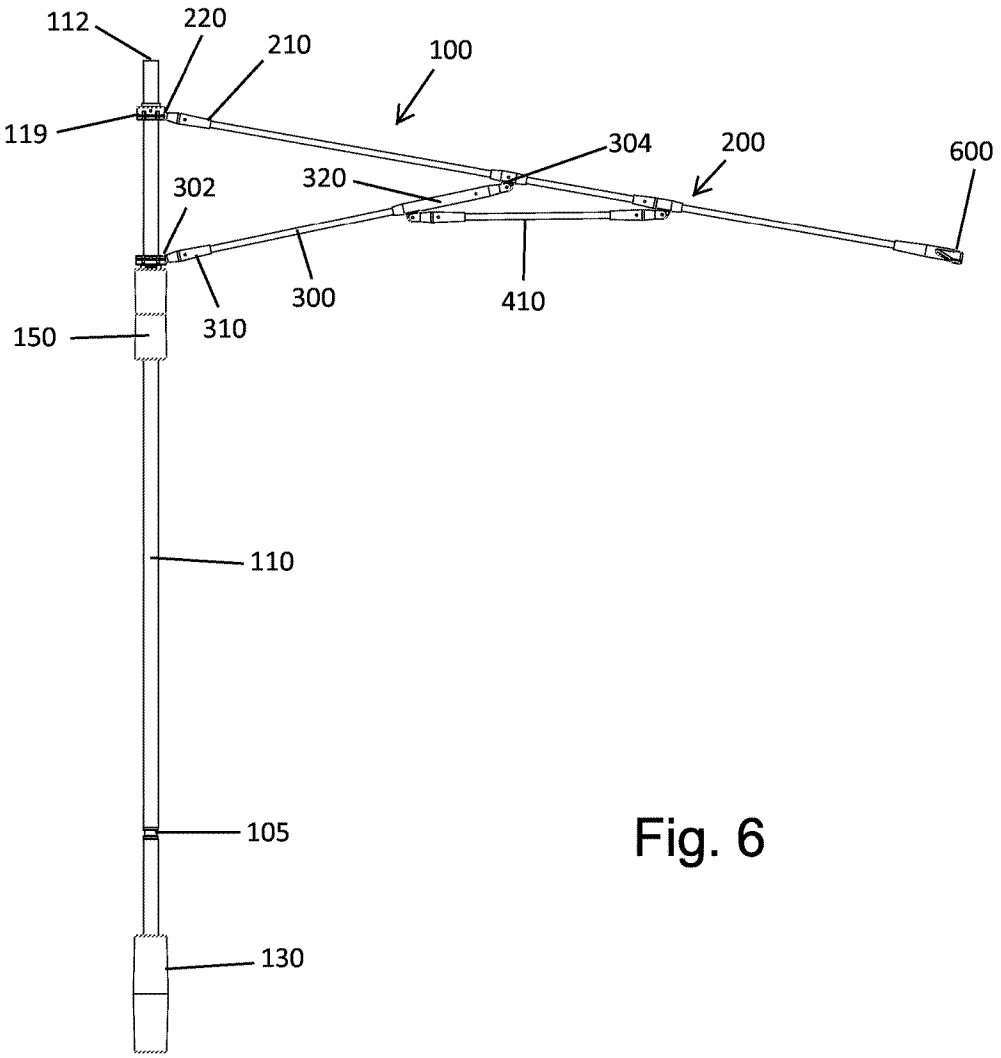
FIG. 6 is a side elevation view of an umbrella, of a manual type, including a shaft and an exemplary umbrella rib assembly being shown in a fully opened position, with only a single rib assembly being shown for sake of illustration purposes only.
Figure 7:
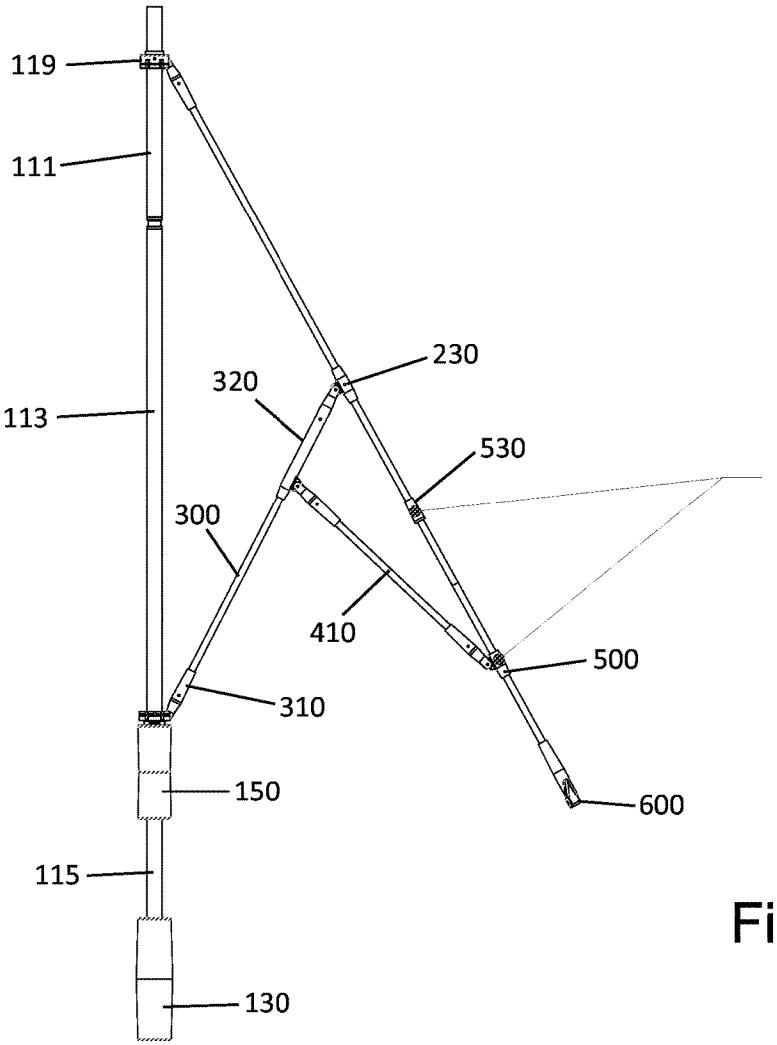
FIG. 7 is a side elevation view of the umbrella rib assembly of FIG. 6 shown in a half open position.
Figure 8:
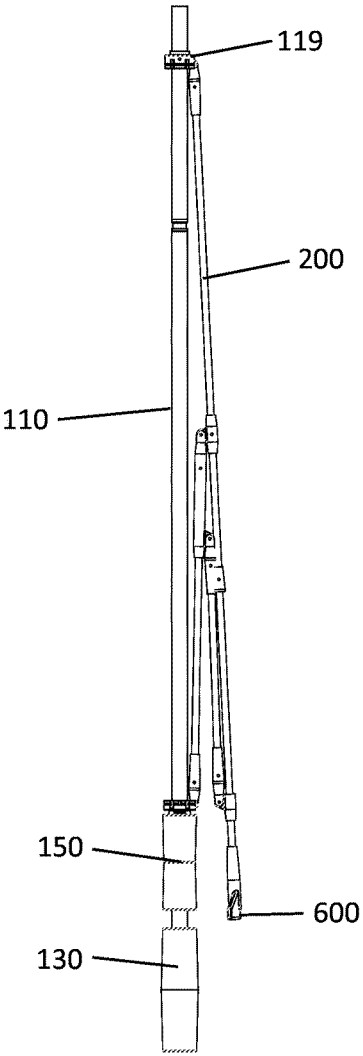
FIG. 8 is a side elevation view of the umbrella rib assembly of FIG. 6 shown in a closed position.
Figure 9:
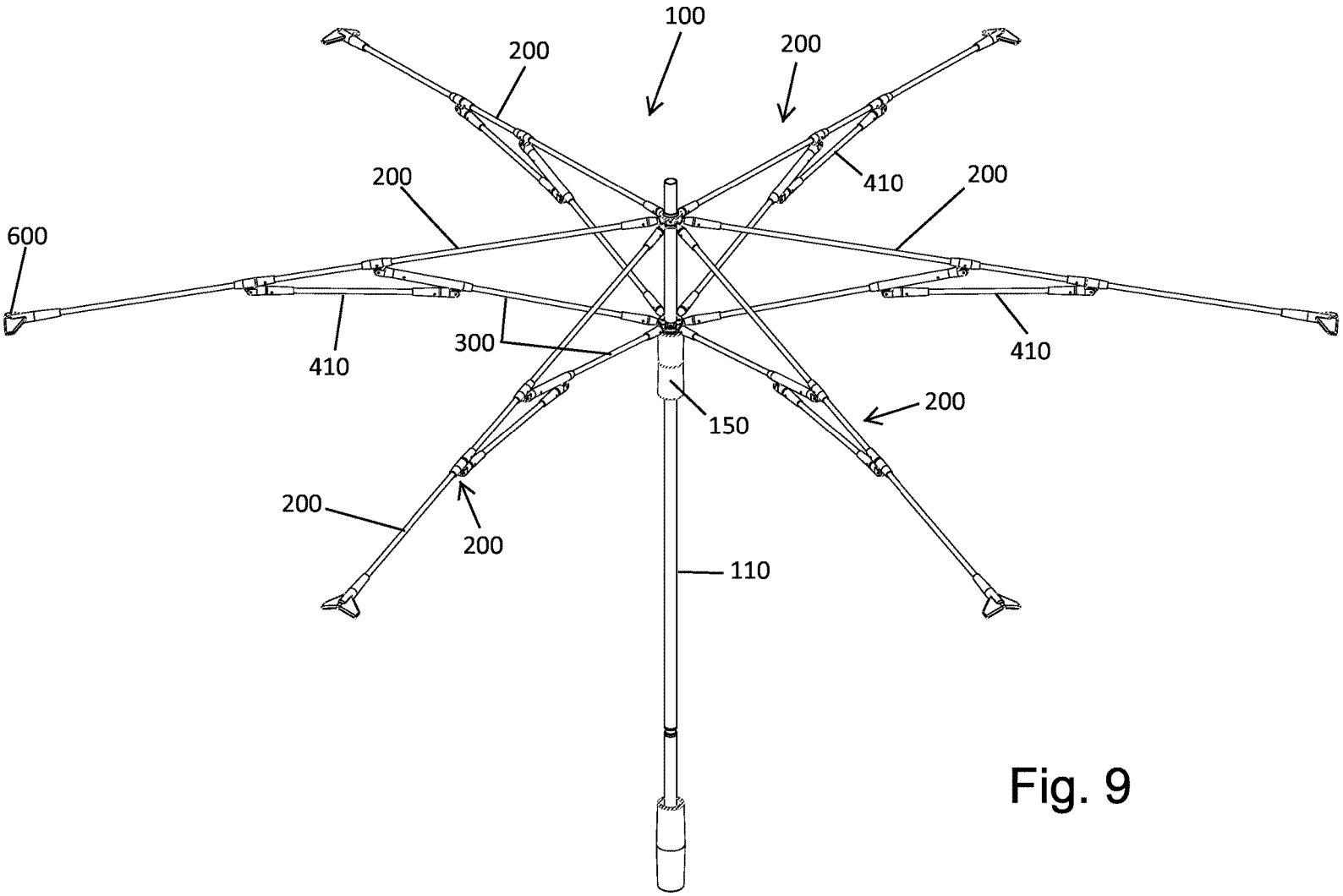
FIG. 9 is a perspective view of an umbrella having a plurality of rib assemblies of FIG. 6 being shown in a fully open position.
Figure 10:
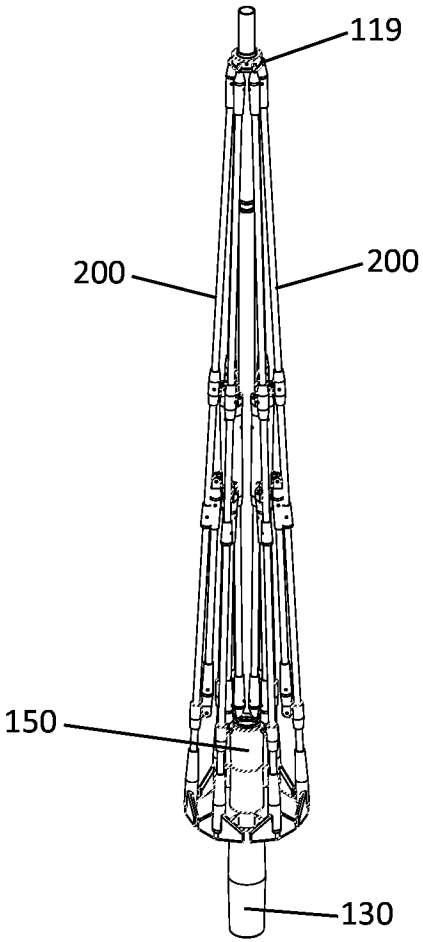
FIG. 10 is a perspective view of the umbrella of FIG. 9 being shown in a fully closed position.

The umbrella 100 includes a plurality of ribs (rib assemblies) 200 that are coupled to both a top notch (stationary hub) 119 (FIG. 6) and the runner 150 and this results in the opening and closing of the ribs 200 and the attached canopy (described in detail below) based on the direction of movement of the runner 150. The connection between each rib 200 and the runner 150 is made by a strut 300. The strut 300 is an elongated structure that has a first end 302 and an opposite second end 304, with the first end 302 being pivotally attached to the rib 200 and the second end 304 being pivotally attached to the runner 150. The pivotal connection between the strut 300 and the runner 150 and between the strut 300 and the rib assembly 200 can be accomplished with a fastener, such as a rivet or pin, etc. More specifically, a first strut joint 310 is formed between the strut 300 and the rib 200 at first end 302 and a second strut joint 320 is formed between the strut 300 and the runner 150 at the second end 304.

It will be understood that any number of different ribs (rib assemblies) and strut assemblies can be used in the umbrella 100 of the present invention and the ones illustrated herein are merely exemplary and not limiting of the present invention. One exemplary rib and strut assembly is discussed below with reference to FIG. 6.

Wind Resistance Construction

In accordance with one aspect of the present invention, the umbrella 100 is constructed to be resistant to inversion from the wind. The umbrella includes a canopy that is formed of two separate canopies, namely, a lower canopy 350 and an upper canopy 390. As described herein, the lower canopy 350 is the canopy which is secured to the ribs 300. The lower canopy 350 can and preferably does have a traditional shape, such as an octagonal shape in its untensioned state.

The lower canopy 350 is made from a water-resistant material and can be construction from a number of smaller individual panel sections (panels) 360. More specifically, each panel section 360 can be a substantially triangular shaped section 360 and the plurality of sections 360 are cut and sewn together to at least generally conform to the spaced between the ribs 200. The lower canopy 350 includes a central opening which is constructed to fit tightly over the hub 119. The lower canopy 350 is also preferably secured to the hub 119 using any number of conventional means.

In the illustrated embodiment in which each panel section 360 has a triangular shape, corners 365 of the lower canopy 350 correspond to the seam lines between the panel sections 360.

As discussed herein, quite often, a gust of wind catches the umbrella user unaware and the wind exerts a force against the inner surface of the lower canopy 350. Such force will cause the lower canopy 350 to invert from the position shown in FIG. 1 to an upwardly convex or bowed position. In order to address the inadvertent inversion of the canopy, the lower canopy 350 includes a plurality of air vents. In particular, each panel section 360 can include a vent opening (hole) 370.

Each vent opening 370 can be formed to have any number of different shapes so long as they function as described herein and provide a vent for air to escape between the two canopies 350, 390. More specifically, air entering the underside of lower canopy 350 will exit through vent openings 370 so as to allow relief for the wind pressure that would normally invert umbrella 100. In the illustrated embodiment, the vent opening 370 has an egg shape; however, it can be formed to have any number of other shapes.

In order to prevent rain from entering vent holes 370, while simultaneously permitting air to exit from the underside of lower canopy 350 through vent holes 370, the upper canopy 390 is positioned over lower canopy 350 in covering relation to vent holes 370. Upper canopy 390 is preferably comprised of the same water-resistant material as lower canopy 350 and is preferably made from a corresponding number of panel sections (panels) 395 as lower canopy 350. However, each panel section 395 has a dimension in the radial direction of umbrella 10 which is less than that of the corresponding panel section 360 of lower canopy 350.

A center opening is also provided in upper canopy 390 and, like the lower canopy 350, the upper canopy is attached about the shaft 110.

In order to secure the peripheral edge of upper canopy 390 to umbrella 100, a strip of elastic material 600 has first ends 602 thereof sewn or otherwise attached to corners 397 of adjacent sectors 395 of upper canopy 390 and opposite ends 604 are attached to corners 365 of adjacent sectors 360 of the lower canopy 350. Because of the use of an elastic strip 600, upper canopy is maintained in a slightly taut condition, whether umbrella 100 is in the opened position or the closed position.

Figure 2:
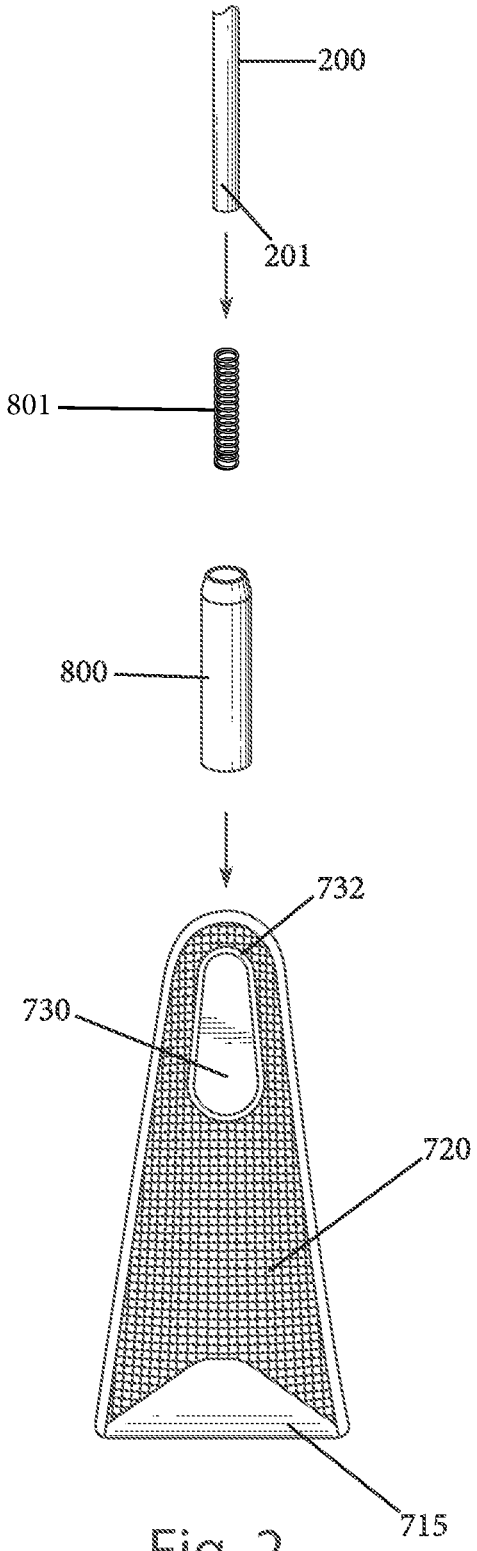
FIG. 2 is an exploded rear view of a flexible connector which has a pocket for receiving a rib.
Figure 3:
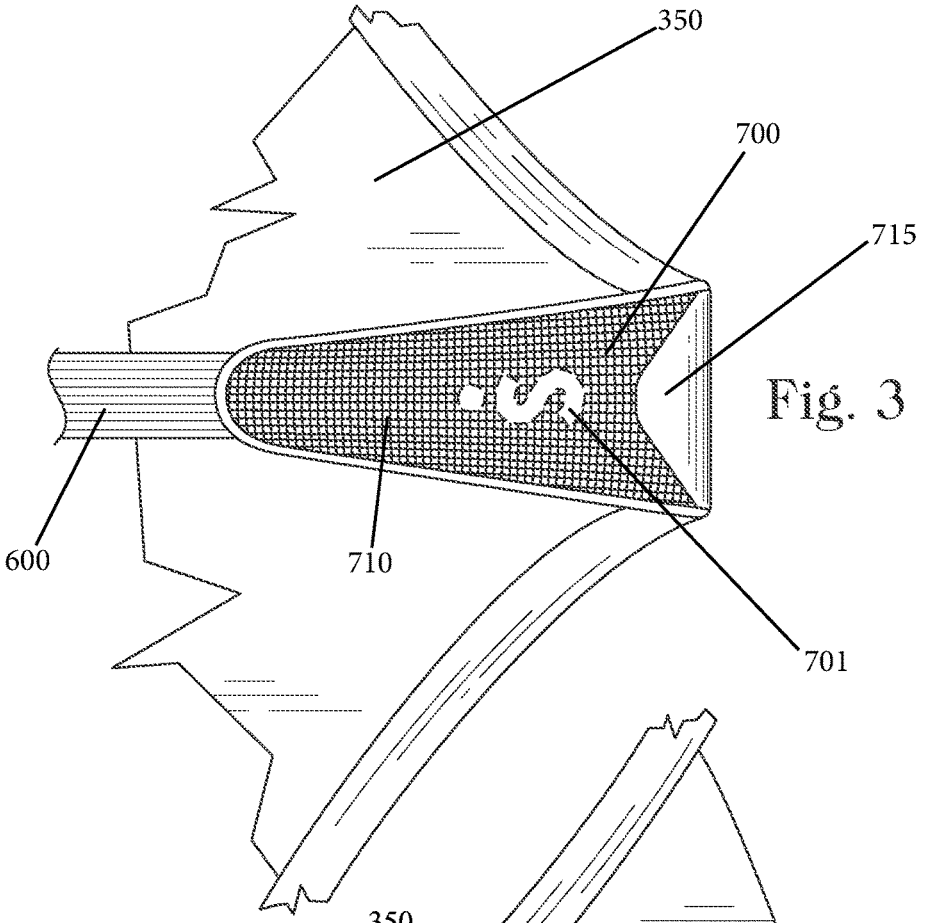
FIG. 3 is a front elevation view of the flexible connector.
Figure 4:
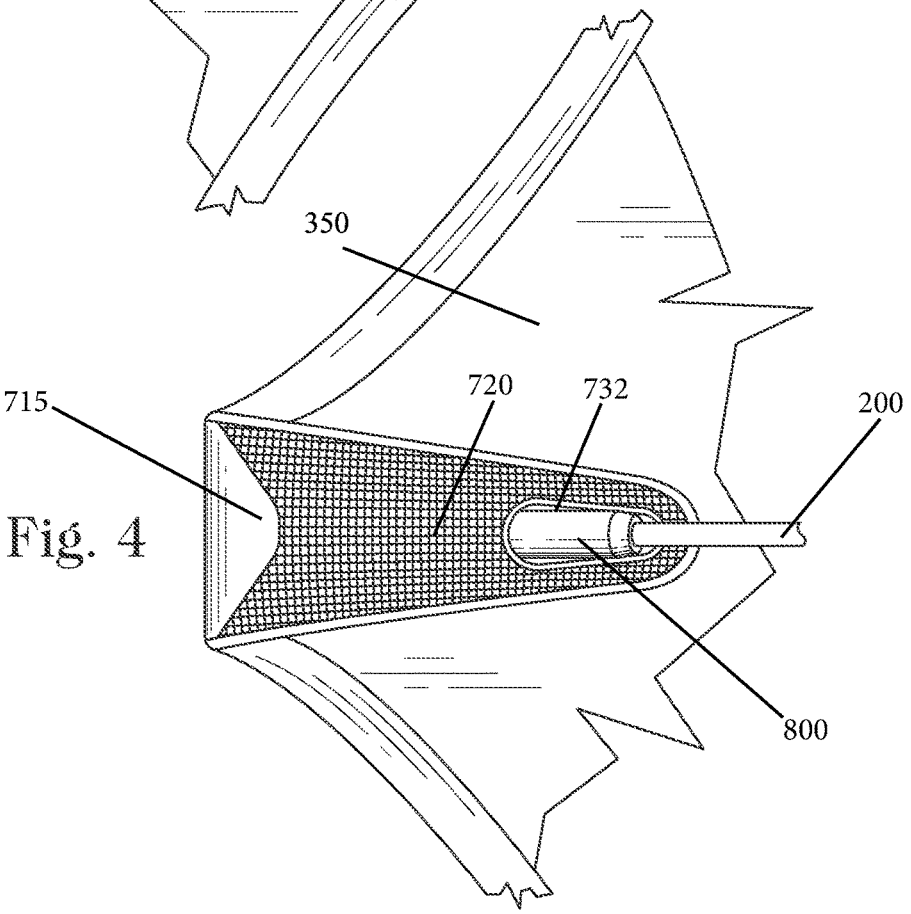
FIG. 4 is a rear elevation view of the flexible connector with the free end of the rib being received within the pocket.
Figure 5:
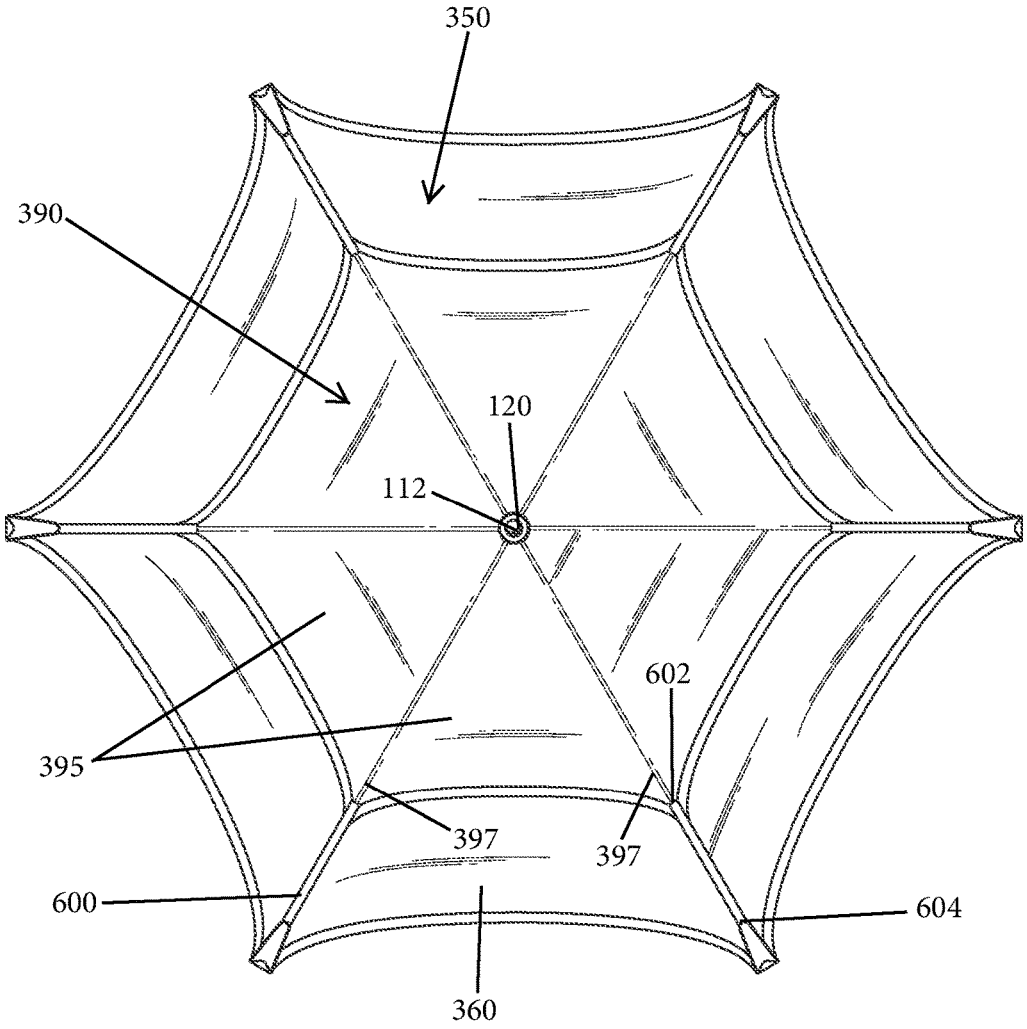
FIG. 5 is a top plan view of the umbrella of FIG. 1.

In accordance with the present invention, a plurality of connectors 700 with each connector 700 being configured for not only securing a second end 604 of the strap 600 to the lower canopy 350 but also for securing the lower canopy 350 to a distal end of one rib 200. As shown in FIGS. 2-4, the connector 700 is configured to wrap around the peripheral edge of the lower canopy 350 in that the connector 700 has a first portion 710 that is disposed and secured along an outer surface of the lower canopy 350 and a second portion 720 that is disposed and secured along an inner surface of the lower canopy 350.

The connector 700 is thus an elongated member that is flexible to allow it to wrap around from the outer surface to the inner surface of the lower canopy 350. The connector 700 is thus formed of a suitable material that permits such wrapping of the connector 700. For example, the connector 700 can be formed of a rubber material or a synthetic material or the like.

As shown in the figures, each of the first and second portions 710, 720 has a tapered construction with the connector 700 being narrower at each end compared to a middle portion 715 of the connector 700. The middle portion 715 is the portion that wraps around the peripheral edge of the lower canopy 350.

As shown in FIG. 3, the first portion 710 along the outer surface of the lower canopy 350 can serve as an area on which indicia 701, such as a corporate or product name or logo, can be placed.

The second end 604 of the strap 600 can be captured below the first portion 710 of the connector 700 and the outer surface of the lower canopy 350, thereby securely attaching the second end 604 of the strap 600 to the lower canopy 350. It will be appreciated that any number of different techniques can be used to capture the second end 604 beneath the first portion 710 of the connector 700. For example, stitching can be used with the stitching passing through edges of both the connector 700 and the strap 600 as well as the lower canopy 350. In fact, the stitching can pass through the second portion 720 along the inner surface of the lower canopy 350 so as to effectively attach the first and second portions 710, 720 to the lower canopy 350.

It will be understood that other techniques can be used to securely attach the connector 700 to the lower canopy 350 including but not limited to the use of adhesives or other bonding agents or other mechanical fasteners, etc. In any event, the connector 700 captures the strap 600 and fixes it relative to the lower canopy 350.

The second portion 720 of the connector 700 is formed such that it defines a pocket 730. The pocket 730 is defined between the underside of the second portion 720 and the inner surface of the lower canopy 350. The connector 700 has an opening 732 formed at or near the end of the connector 700 and this opening 732 defines an entrance into the pocket 730. It will be understood that the attachment (e.g., as by stitching) of the second portion 720 to the lower canopy 350 creates the interior pocket underneath the second portion 720.

The pocket 730 and opening 732 are configured and sized to receive a distal end 201 of the rib 200. A tip cap 800 can be provided for securely locating and holding the distal end 201 of the rib 200 in place in the pocket 730. The tip cap 800 can have a tubular construction and is preferably securely anchored within the interior space of the pocket 730. The tip cap 800 has an open end and an opposite closed end. Any number of different techniques can be used to anchor the tip cap 800 within the pocket 730. For example, an adhesive or other bonding agent can be used to securely anchor the tip cap 800 in the pocket 730.

The tip cap 800 can have any number of different shapes including the tubular cylindrical structure shown in FIG. 2 or it can have another shape, such as the shape shown in FIGS. 10A-10D of the '906 application previously incorporated herein.

As shown in FIG. 2, the rib 200 is spring biased within the tip cap 800 by a biasing element 801 which is in the form of a spring. The spring element 801 is configured to be received within the hollow interior (bore) of the tip cap 800 between a closed end of the tip cap 800 and the distal end 201 of the rib 200. The spring 801 adds tension to the canopy. Many traditional umbrellas have "slack". The present canopy and the spring 801 are constructed such that the spring 801 picks up the slack creating a taught canopy.

To couple the rib 200 to the connector 700, the lower canopy 350 is manipulated and the distal end 201 of the rib 200 is inserted into the open end of the tip cap 800. Since the canopies are under tension (via spring 801), the distal end of the 201 of the rib 200 contacts the closed end of the tip cap 800.

Figure 15:
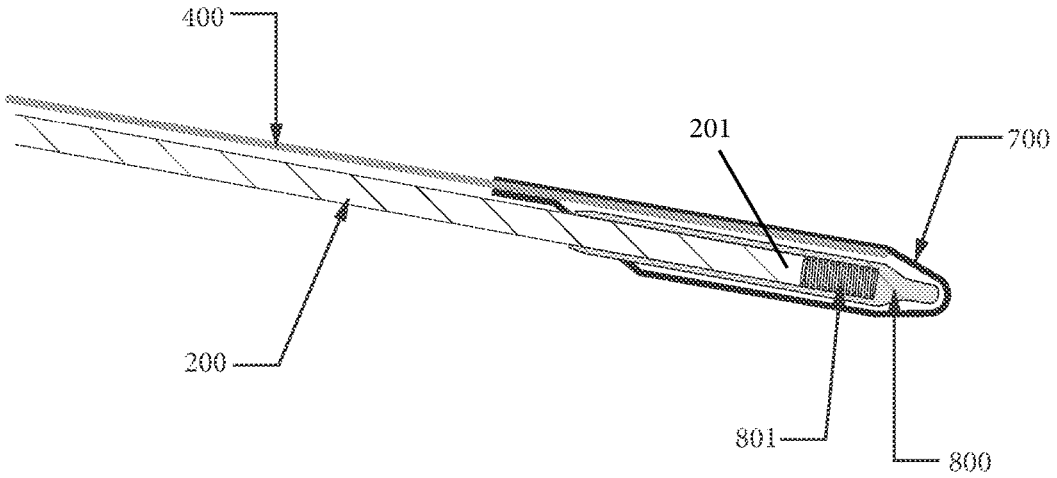
FIG. 15 is a cross-sectional view taken through the rib and connector.

FIG. 15 also shows the arrangement of the rib 200, connector 700 and the tip cap 800. FIG. 15 shows the rib 200 underneath the canopy 350 and the distal end 201 of the rib 200 is disposed within the canopy tip cap 800. The spring 801 is compressed between the distal tip 201 and the closed end of the tip cap 800 (thereby defining a spring loaded tip). The connector 700 (e.g., rubber canopy) surrounds the tip cap 800 as shown.

In this manner, the connector 700 represents a single structure that not only fixedly attaches one end of the elastic strap 600 to the lower canopy 350 but also detachably couples one rib 200 to the lower canopy 350. In this manner, the canopies 350, 390 are attached to one another and the ribs 200 are coupled to the canopy 350 as well.

In sum, the rubber canopy tip (i.e., connector 700) is attached (e.g., stitched) to the canopy to create a pocket. The rib 200 is connected to the plastic rib tip 800 with a spring 801 in between the two which deploys a constant pressure to the rubber canopy tip, which in turn pulls the canopy to a taught shape. The rubber canopy tip (connector 700) is attached (sewn) to the canopy creating a pocket for the rib tip 800 to fit inside of, which then spreads the load on the canopy fabric. By spreading the load on the canopy, it limits the ability of torn canopies at the tips (seams) (which is a common problem with umbrellas). In other words, the rubber pocket (i.e., connector 700) helps deploy pressure (generated by the tensioned rib) over a larger area which reduces the risk of the canopy 350 tearing at the seams (i.e., where adjacent canopy panels are attached to one another).

The connector 700 also can act as a safety feature in that the connector 700 can be formed of a softer material, such as rubber, and is represented by a relatively large, soft surface in the event that the umbrella was blown into contact with one's body or a body of a third party. In other words, the rubber pocket (i.e., connector 700) also acts as a safety feature by creating a large flat surface on the edge instead of a sharp tip.

It will be appreciated that the rubber canopy tip (connector 700) can be made of any number of other materials, such as leather, silicon, fabric, etc., and therefore is not limited to being formed of rubber.

Exemplary Rib Assembly

As shown in FIGS. 6-13D, the rib assembly 200 is formed of a number of components that are coupled to one another and to other components of the umbrella to provide a rib assembly that opens and closes. In the illustrated embodiment, the rib assembly 200 includes a plurality of ribs.

The umbrella 100 also includes the top notch (hub) 119 that is an annular shaped member that is attached to the shaft 110 and surrounds the shaft 110. The top notch 119 is configured to receive ribs 200 and thus serves an attachment point for such ribs. The ribs are attached to the shaft 110 by fitting into the top notch 119 and can then be held by a wire or other means. The top notch 119 can be a thin, round nylon or plastic piece with teeth around the edges.

As will be appreciated by the following description, each rib 200 is coupled to both the top notch 119 and the runner 150 and this results in the opening and closing of the rib 200 and the attached canopy (not shown) based on the direction of movement of the runner 150. The connection between the rib 200 and the runner 150 is made by a strut 300 (main strut). The strut 300 is an elongated structure that has a first end 302 and an opposite second end 304, with the first end 302 being pivotally attached to the runner 150 and the second end 304 being pivotally attached to the rib 200. The pivotal connection between the strut 300 and the runner 150 and between the strut 300 and the rib 200 can be accomplished with a fastener, such as a rivet or pin, etc. More specifically, a first strut joint 310 is formed between the strut 300 and the runner 150 at the first end 302 and a second strut joint 320 is formed between the strut 300 and the rib 200 at second end 304.

Figure 11:
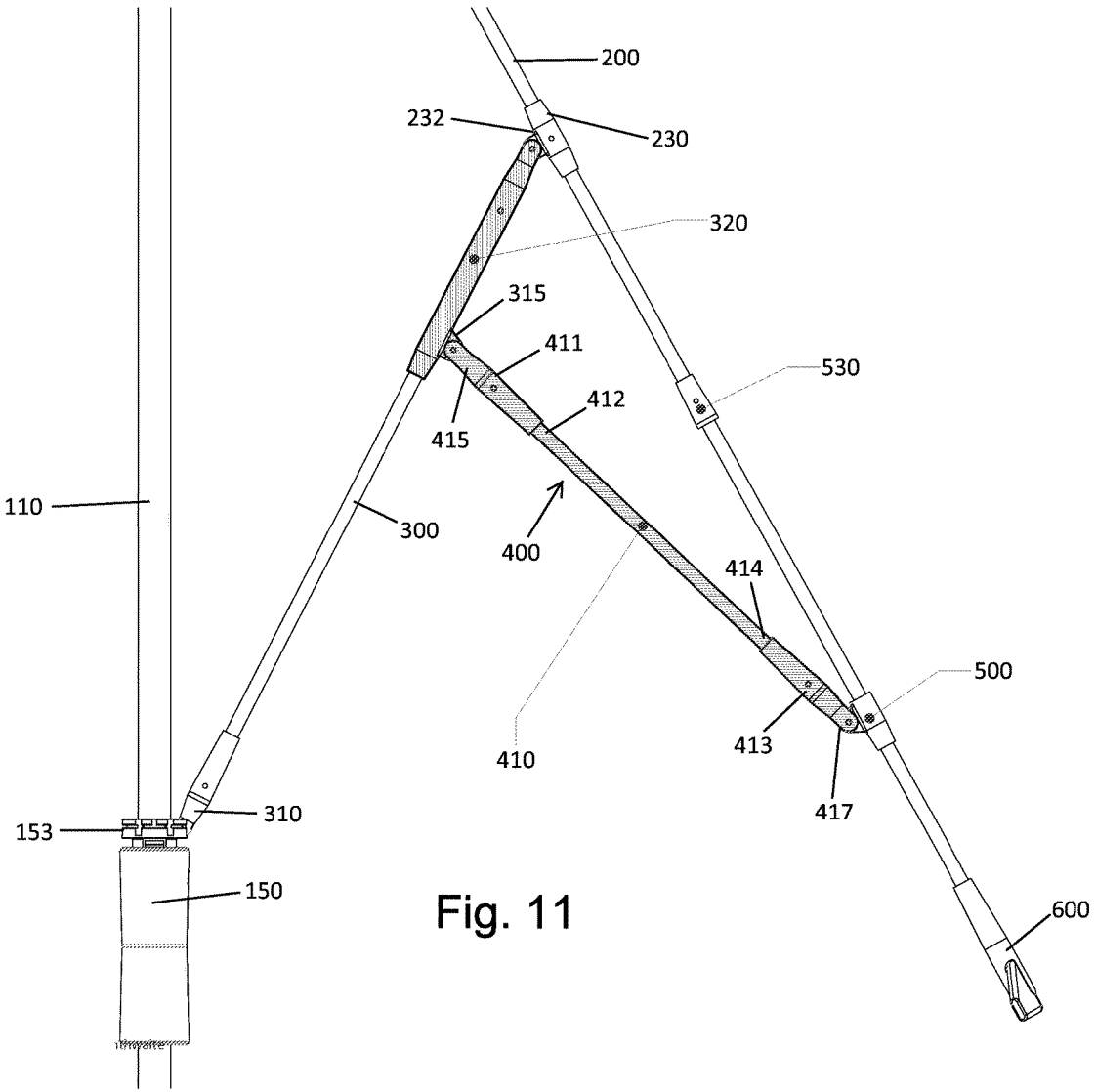
FIG. 11 is an enlarged cross-sectional view of a portion of the rib assembly of FIG. 6 showing the anti-inversion feature of the present invention.
Figure 12A:
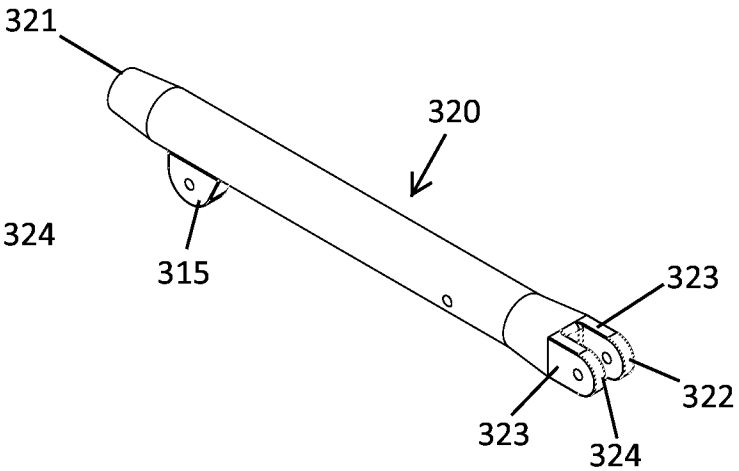
FIG. 12A is a perspective view of a strut to rib joint of the rib assembly of FIG. 1.
Figure 12D:
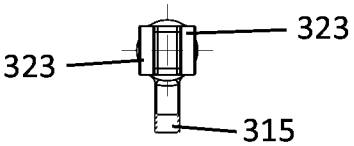
FIG. 12D is an end view of the strut to rib joint of FIG. 7A.
Figure 12C:
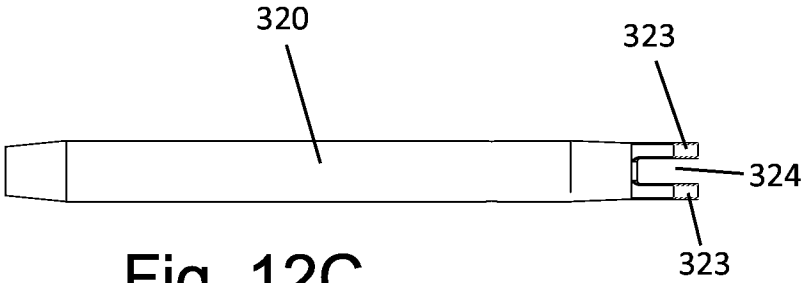
FIG. 12C is a top plan view of the strut to rib joint of FIG. 7A.
Figure 12B:
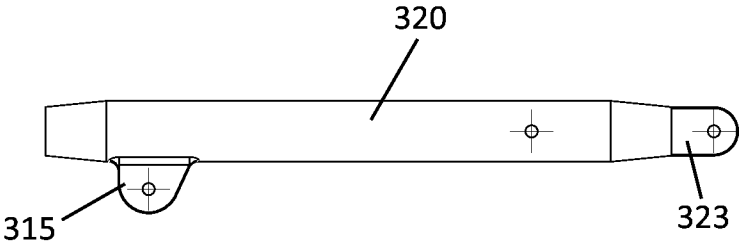
FIG. 12B is a side elevation view of the strut to rib joint of FIG. 7A.
Figure 13A:
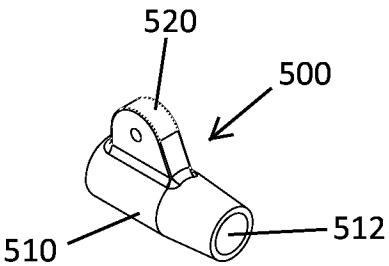
FIG. 13A is a perspective view of a floating joint of the rib assembly of FIG. 6.
Figure 13D:
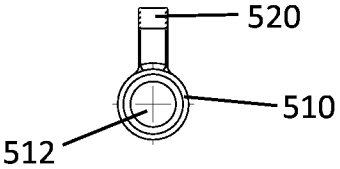
FIG. 13D is an end view of the floating joint of FIG. 13A.
Figure 13C:
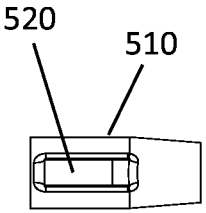
FIG. 13C is a top plan view of the floating joint of FIG. 13A.
Figure 13B:
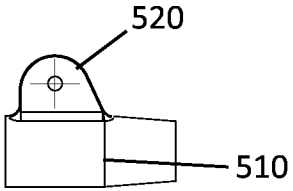
FIG. 13B is a side elevation view of the floating joint of FIG. 13A.
Figure 14A:
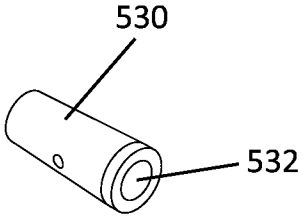
FIG. 14A is a perspective view of a floating joint stop of the rib assembly of FIG. 1.
Figure 14D:
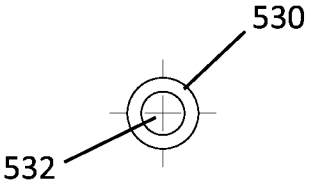
FIG. 14D is an end view of the floating joint stop of FIG. 14A.
Figure 14C:
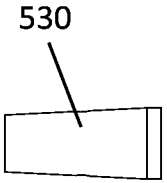
FIG. 14C is a top plan view of the floating joint stop of FIG. 14A.
Figure 14B:
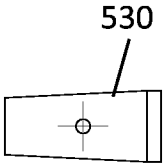
FIG. 14B is a side elevation view of the floating joint stop of FIG. 14A.

As shown in FIG. 11, the first strut joint 310 can be in the form of a male end joint that is configured to pivotally attach to the runner 150 to allow the strut 300 to pivot between an open position and a closed position.

The second strut joint 320 is in the form of a double joint and is best shown in FIGS. 11 and 12A-D. The second strut joint 320 can also be thought of as being a strut to rib joint and includes a first end 321 that attaches to the distal end of the strut 300 and a second end 322 which includes a pair of spaced fingers 323 that are parallel to one another and define an open space 324 therebetween and have aligned openings formed therein to allow passage of a fastener or the like to couple the joint to another structure (rib) as discussed below. As shown in FIGS. 12A-D, the second strut joint 320 also includes a joint connector 315 which can be in the form of a fin that protrudes outwardly from the body of the joint 310 (i.e., the connector 315 is formed perpendicular to the body of the connector 315). The joint connector 315 has an opening formed therein to allow a fastener to pass therethrough to allow to another structure to be pivotally attached to the joint connector 315.

The strut 300 can be formed of any number of different materials including a metal (e.g., a zinc alloy).

As shown in the figures, the rib 200 is an elongated structure that is coupled to other components of the umbrella to provide a rib assembly defined by a plurality of ribs 200 that open and close.

Each rib 200 is an elongated, flexible structure that has a first end (proximal end) 210 and an opposing second end (distal end) 212. The first end 210 is pivotally attached to the top notch 119 and more specifically, a first rib joint 220 can be provided at the first end 210 and be designed to allow the rib 200 to pivot relative to the top notch 119. In the illustrated embodiment, the first rib joint 220 can be in the form of a male end joint that can have a similar or the same construction as the first rib joint 310 that is part of the strut assembly.

As best shown in FIG. 11, the rib 200 also includes a second rib joint 230 that is disposed along the length of the rib 200. The second rib joint 230 can be fixedly attached to the rib 200 at a specific location thereof. The second rib joint 230 can thus be in the form of a hollow structure that receives the rib 200 and is fixedly attached to the rib 200 so that during use, the second rib joint 230 does not move but rather remains at the fixed location. The second rib joint 230 has a connector portion 232 in the form of a fin (protrusion) that extends radially outward therefrom. The connector portion 232 can thus be formed perpendicular to the body of the second rib joint 230. The connector portion 232 includes an opening formed therethrough.

With reference to FIGS. 11 and 12A-D, the connector portion 232 is sized and configured to disposed within the open space 234 defined between the pair of spaced fingers 323 of the second strut joint 320. When inserted into the open space 234, the opening formed in the connector portion 232 axially aligns with the openings in the fingers 323 to allow passage of a fastener (such as a pin or rivet or wire, etc.), whereby the second strut joint 320 is pivotally attached to the rib 200 (and thus, the strut 300 is pivotally attached to the rib 200).

According to one aspect of the present invention, an anti-inversion mechanism (feature) 400 is provided and is configured to counter an inversion force that is applied to the umbrella during select operating conditions and in particular, during windy conditions or other adverse conditions. As is well known by users of umbrellas, if a sudden gust of wind is directed upwardly toward the inside of the umbrella, the pressure applied by the wind will invert the canopy causing the ribs to work counterproductively forcing it outwards. The canopy generally assumes a concave shape when inversion occurs and similarly, the ribs are force to pivot in unintended directions which can result in one or more ribs breaking. This renders the umbrella not usable. The umbrella of the present invention has the anti-inversion mechanism 400 that is made up of several components that are individually discussed below.

As shown in FIG. 11 and FIGS. 13A-C, the anti-inversion mechanism 400 comprises an anti-inversion strut 410 that has a first end 412 that is coupled to the strut 300 and an opposite second end 414 that is coupled to the rib 200. More specifically, the first end 412 is coupled to the second strut joint 320 and the second end 414 is coupled to the rib 200. The anti-inversion strut 410 has a first end joint 411 at the first end 412 and a second end joint 413 at the second end 414. The illustrated first and second end joints 411, 413 are in the form of female end joints and in particular, the first end joint 411 is defined by a pair of spaced apart fingers 415 that has an open space formed therebetween and the second end joint 413 is also defined by a pair of spaced apart fingers 417 that has an open space formed therebetween. The joint connector 315 (a male joint) is received into the open space between the fingers 415 (a female joint) of the first end joint 411, thereby coupling the anti-inversion strut 410 to the strut 300 in manner in which the anti-inversion strut 410 can pivot relative to the strut 300.

The first and second end joints 411, 413 can be mechanically fixed to the elongated strut body or the end joints 411, 413 can be molded over an existing strut material.

The anti-inversion strut 410 can be formed of any number of different materials including metals and synthetics. In one exemplary embodiment, the anti-inversion strut 410 comprises a 6 mm carbon Fiber rod.

The anti-inversion mechanism 400 also includes a floating joint 500 that is slidingly coupled to the rib 200 and configured to mate with the second end joint 413. FIGS. 13A-D illustrate the floating joint 500. The floating joint 500 has a main body 510 that includes a bore 512 that is formed therein and represents a through hole that passes from one end of the main body 510 to the other end thereof. The floating joint 500 also includes a joint connector 520 in the form of a fin that extends radially outward from the main body 510. The connector 520 can be formed perpendicular to the main body 510. The connector 520 has an opening formed therein. The connector 520 thus represents a male joint.

The anti-inversion strut 410 is coupled to the rib 200 by inserting the connector 520 between the spaced fingers 417 of the second end joint 413. As in the other joint, a fastener or the like can be used to couple the connector 520 to the fingers 417.

The rib 200 is received within and passes through the bore 512 and the size (diameter) of the bore 512 and the size (diameter) of the rib 200 are selected such that the floating joint 500 can freely move in a longitudinal direction along the length of the rib 200. This allows the floating joint 500 to be one which can freely travel up (toward the top notch 119) and down the rib 200 (toward the rib tip) when the umbrella opens and closes.

It will be appreciated that in another embodiment, the floating joint can be a male part that includes male connector 520; however, is positioned internal to the rib 200 such that the floating joint is free to move within the hollow inside of the rib 200 (e.g., an aluminum extrusion rib or formed steel rib). The rib 200 could thus have a linear slot formed therein through which the connector 520 passes. The operation of the floating joint is otherwise the same. In this alternative embodiment, the "floating action" of the floating joint thus occurs internally within the rib 200 as opposed to on the outside of the rib 200 in the illustrated embodiment.

With reference to FIGS. 11 and 14A-D, the anti-inversion mechanism 400 also includes a floating joint stop 530 that is fixedly attached to the rib 200. The floating joint stop 530 is disposed between the floating joint 500 and the second rib joint 230 and remains at a fixed location along the rib 200. The stop 530 includes a bore 532 that extends therethrough and receives the rib 200. The stop 530 is fixed to the rib 200 using traditional techniques so as to fix the stop 530 at a specific target location along the length of the rib 200. The stop 530 can be fixed by mechanical or overmolded which is the preferred method in this instance. The stop 530 is constructed such that it restricts the movement of the floating joint 500 in the direction toward the top notch 119.

It will be appreciated that when the umbrella is in the open position, the floating joint 500 rides along the rib 200 until it contacts the floating joint stop 530. The floating joint 500 in combination with the floating joint stop 530 prevents the rib 200 from inverting as when under the force of a strong wind. Inversion is prevented since the rib cannot bend upwardly due to the blocking action of the floating joint stop 530.

As mentioned previously, the above-described rib and strut assembly is merely exemplary in nature and is not limiting of the present invention.

The connector 700 thus provides a quick yet efficient manner for securely coupling the upper canopy 390 to the lower canopy 350 and for releasably securing the ribs 200 to the umbrella (i.e., to the lower canopy 350).

While the invention has been described in connection with certain embodiments thereof, the invention is capable of being practiced in other forms and using other materials and structures. Accordingly, the invention is defined by the recitations in the claims appended hereto and equivalents thereof.

What is claimed:

1. A wind resistant umbrella comprising:

a shaft;

a plurality of ribs extending radially outward from the shaft, each rib having a free end portion;

a lower canopy secured in covering relation on the plurality of ribs, the lower canopy having at least one vent hole formed therein;

an upper canopy positioned over the lower canopy and in covering relation to the at least one vent hole;

elastic fasteners having a first end attached to the upper canopy and a second end attached to the lower canopy to permit the upper canopy to elastically separate from the lower canopy while also covering the at least one vent hole;

a plurality of flexible connectors that are secured along a peripheral edge of the lower canopy with a first portion of the connector lying along and being fixedly and directly secured to a first face of the lower canopy and each connector wrapping around the peripheral edge of the lower canopy such that a second portion of the flexible connector lies along and is fixedly and directly secured to a second face of the lower canopy, wherein the first portion of the flexible connector is securely attached to the second end of the elastic fastener, and wherein the second portion of the flexible connector defines a pocket that receives the free end portion of one respective rib, thereby releasably coupling the rib to the lower canopy, wherein an opening of the pocket is disposed along the second face of the lower canopy, wherein the second portion includes an opening defining an entrance to the pocket, the pocket defined between an underside of the second portion and the lower canopy; and a hollow rib tip cap that is securely anchored within the pocket, an open end of the rib tip cap being accessible through the opening in the second portion, the free end portion being inserted into hollow rib tip cap, wherein a distal end of one rib is received within the hollow rib tip cap with a spring being disposed between the distal end of the rib and a closed end of the hollow rib tip cap for applying a biasing force to the rib tip cap.

2. The umbrella of claim 1, wherein the lower canopy is formed of a plurality of first panels attached to one another and the upper canopy is formed of a plurality of second panels attached to one another, each first panel and each second panel defining part of a peripheral edge of the lower canopy and upper canopy, respectively.

3. The umbrella of claim 2, wherein each first panel includes one vent hole.

4. The umbrella of claim 2, wherein each first panel and each second panel has a triangular shape defined by corners.

5. The umbrella of claim 4, wherein each elastic fastener extends between one corner of the upper canopy and one corner of the lower canopy.

6. The umbrella of claim 1, wherein the elastic fastener comprises an elastic strap.

7. The umbrella of claim 1, wherein the flexible connectors are disposed in corners of the lower canopy.

8. The umbrella of claim 1, wherein the first portion has a tapered construction and the second portion has a tapered construction with the flexible connector being narrower at first and second ends thereof.

9. The umbrella of claim 1, wherein the second end of the elastic fastener is disposed below the first portion of the connector so as to capture the elastic fastener between the connector and the lower canopy.

10. The umbrella of claim 1, wherein the flexible connector wraps around a peripheral edge of the lower canopy.

11. The umbrella of claim 1, wherein the flexible connector is formed of rubber.

12. The umbrella of claim 1, wherein the first portion is attached to the elastic fastener and the lower canopy by stitching that is located along a peripheral edge of the first portion and the second portion is attached to the lower canopy by stitching that is located along a peripheral edge of the second portion.

13. The umbrella of claim 1, wherein a length of the first portion is about equal to a length of the second portion.

14. The umbrella of claim 1, wherein the first and second portions have generally triangular shapes.

15. The umbrella of claim 1, wherein the second end of the elastic fastener is disposed underneath the flexible connector at a location that is spaced from an end of the flexible connector.

16. The umbrella of claim 1, wherein the upper canopy has dimensions less than those of the lower canopy.

17. A wind resistant umbrella comprising:

a shaft;

a plurality of ribs extending radially outward from the shaft, each rib having a free end portion;

a lower canopy secured in covering relation on the plurality of ribs, the lower canopy having at least one vent hole formed therein;

an upper canopy positioned over the lower canopy and in covering relation to the at least one vent hole;

elastic fasteners having a first end attached to the upper canopy and a second end attached to the lower canopy to permit the upper canopy to elastically separate from the lower canopy while also covering the at least one vent hole; and a plurality of flexible connectors that are secured along a peripheral edge of the lower canopy with a first portion of the connector lying along a first face of the lower canopy and each connector wrapping around the lower canopy such that a second portion of the flexible connector lies along a second face of the lower canopy, wherein the first portion of the flexible connector is securely attached to the second end of the elastic fastener and to the lower canopy, and wherein the second portion of the flexible connector defines a pocket that receives the free end portion of one respective rib, thereby releasably coupling the rib to the lower canopy;

wherein the second end of the elastic fastener is disposed below the first portion of the connector so as to capture the elastic fastener between the connector and the lower canopy; wherein stitching passes through the first portion, the second end of the elastic fastener, the lower canopy, and the second portion.

18. A wind resistant umbrella comprising:

a shaft;

a plurality of ribs extending radially outward from the shaft, each rib having a free end portion;

a lower canopy that has at least one vent hole formed therein;

an upper canopy positioned over the lower canopy and in covering relation to the at least one vent hole, wherein the lower canopy extends distal to an outer peripheral edge of the upper canopy as well as distal to the free end portion of the rib;

elastic fasteners having a first end attached to the upper canopy and a second end attached to the lower canopy to permit the upper canopy to elastically separate from the lower canopy while also covering the at least one vent hole; and a plurality of flexible connectors that extend along an upper surface of the lower canopy and wrap around the outer peripheral edge of the lower canopy and then extend along a lower surface of the lower canopy, each flexible connector covering and fixedly attaching a second end of one respective elastic fastener to an upper surface of the lower canopy and defines a pocket that opens along the lower surface of the lower canopy, the pocket receiving the free end portion of one respective rib, thereby releasably coupling the respective rib to the lower canopy;

wherein the elastic fasteners and ribs are superimposed with respect to one another and the free end portions of the respective ribs are spaced internally along the lower surface of the lower canopy away from the outer peripheral edge of the lower canopy.

19. A wind resistant umbrella comprising:

a shaft;

a plurality of ribs extending radially outward from the shaft, each rib having a distal end portion;

a lower canopy secured in covering relation on the plurality of ribs and being defined by a plurality of panels joined to one another along seams, wherein a corner is defined between adjacent panels of the lower canopy, the lower canopy having at least one vent hole formed therein;

an upper canopy positioned over the lower canopy and in covering relation to the at least one vent hole;

elastic fasteners having a first end attached to the upper canopy and a second end attached to the lower canopy to permit the upper canopy to elastically separate from the lower canopy while also covering the at least one vent hole; and a plurality of flexible connectors that are secured to the corners of the lower canopy and at least partially cover the seams and wrap around a peripheral edge of the lower canopy, wherein a first portion of each connector lies along a first face of the lower canopy and wraps around one corner of the lower canopy such that a second portion of the flexible connector lies along a second face of the lower canopy, wherein the first portion of the flexible connector is securely attached to the second end of the elastic fastener and to the lower canopy, and wherein the second portion of the flexible connector defines a pocket that receives the distal end portion of one respective rib, wherein the flexible connector is configured such that a load that is applied to the lower canopy is spread across the lower canopy, thereby reducing the likelihood that the lower canopy will tear along one or more seams;

wherein the connector includes a peripheral edge portion which is formed intermediate to first and second ends of the connector when the connector is in a flat elongated orientation, the peripheral edge portion being a portion of the connector that wraps around one corner of the lower canopy, the peripheral edge portion having a first triangular shaped first end that is disposed along the first face of the lower canopy and a second triangular shaped second end that is disposed along the second face of the lower canopy.

20. The umbrella of claim 19, wherein the peripheral edge portion is formed of rubber.

* * * * *